US010123579B2

(12) United States Patent
Brunelle

(10) Patent No.: US 10,123,579 B2
(45) Date of Patent: Nov. 13, 2018

(54) KIT AND METHOD FOR FACILITATING TYING A TIE

(71) Applicant: TieQ, LLC, Lake Tapps, WA (US)

(72) Inventor: Nicholas A. Brunelle, Lake Tapps, WA (US)

(73) Assignee: TieQ, LLC, Lake Tapps, WA (US)

( * ) Notice: Subject to any disclaimer, the term of this patent is extended or adjusted under 35 U.S.C. 154(b) by 863 days.

(21) Appl. No.: 14/295,167

(22) Filed: Jun. 3, 2014

(65) Prior Publication Data

US 2014/0352028 A1 Dec. 4, 2014

Related U.S. Application Data

(60) Provisional application No. 61/831,104, filed on Jun. 4, 2013.

(51) Int. Cl.
*A41D 25/08* (2006.01)

(52) U.S. Cl.
CPC ..... *A41D 25/08* (2013.01)

(58) Field of Classification Search
CPC ..... A41D 25/08
See application file for complete search history.

(56) References Cited

U.S. PATENT DOCUMENTS 2,994,886 A * 8/1961 Sharp ..... A41D 25/06 2/146
3,025,528 A * 3/1962 Minter ..... A41D 25/06 2/144
3,271,780 A * 9/1966 De Jean ..... A41D 25/06 2/146
3,305,933 A * 2/1967 Munday, Jr. ..... A41D 25/00 33/2 R
3,321,773 A * 5/1967 Orciuch ..... A41D 25/06 2/146
3,335,426 A * 8/1967 Light ..... A41D 25/06 2/146
3,490,073 A * 1/1970 Webster ..... A41D 25/06 2/146
3,571,935 A * 3/1971 Van Wye ..... A41D 25/08 2/146
3,663,961 A * 5/1972 Piper ..... A41D 25/02 2/153
3,747,220 A * 7/1973 Weisnicht ..... A41D 25/08 2/146
3,797,044 A * 3/1974 Chow ..... A41D 25/00 2/146

(Continued)

OTHER PUBLICATIONS http://microsoft_encarta.en.downloadastro.com/ (accessed Apr. 30, 2017).*

*Primary Examiner* — Shaun R Hurley
(74) *Attorney, Agent, or Firm* — Lee & Hayes, PLLC

(57) ABSTRACT

Based on a person's neck size, torso length measured from the neck to the waistline, and a constant that depends upon the type of knot that will be tied, a position for attaching a marker on a rear surface of the tie can be determined. The marker then provides a reference point to indicate where a broader portion of the tie should cross over the narrower portion after the tie is looped around a person's collar. This approach ensures that the tie will always be tied with the correct length of the broad end hanging below the knot.

10 Claims, 6 Drawing Sheets

(56) References Cited

U.S. PATENT DOCUMENTS

| | | | | | |
|---|---|---|---|---|---|
| 4,845,857 | A | * | 7/1989 | Klosterman | A41D 25/08 33/485 |
| 5,088,118 | A | * | 2/1992 | Whiteley | A41D 25/08 2/137 |
| 5,105,553 | A | * | 4/1992 | Weston | A41D 25/08 2/146 |
| 5,326,004 | A | * | 7/1994 | Daily, Jr. | A41D 25/08 2/144 |
| 5,505,002 | A | * | 4/1996 | Falco | A41D 25/08 2/144 |
| 5,864,881 | A | * | 2/1999 | Simmons | A41D 25/08 2/144 |

* cited by examiner

KIT AND METHOD FOR FACILITATING TYING A TIE

RELATED APPLICATION

This application is based on a prior provisional application, Ser. No. 61/831,104 filed on Jun. 4, 2013, the benefit of the filing dates of which is hereby claimed under 35 U.S.C. § 119(e).

BACKGROUND

Depending upon the type of job a person has, it may be necessary for the person to wear a suit, a dress shirt, and a tie to work each day. While local standards and dress code may differ, a professional, such as a lawyer, doctor, or business person might be considered inappropriately dressed if not wearing a dress shirt and tie, even if not wearing suit coat. There are also many occasions for which appropriate dress includes wearing a tie, regardless of a person's work. Furthermore, the wearing of ties is not limited to males, since women professionals may also choose to wear a suit and tie. Ties have thus become a common part of a person's wardrobe, no matter how often they are worn.

A person may own a number of ties that have been purchased to match specific suits and/or shirts, or received as gifts. The ties worn by a person can vary somewhat in length, because there does not appear to be a fixed standard. As a result, each time that a person selects a different tie to wear, there is often uncertainty about where to initially start to form the knot to ensure that the broad end of the ties hangs down the correct length from the neck. If the knot is formed at the wrong place, the tie may hang too short, and in some cases where the initial guess about where to start the knot is really wrong, the narrow end of the tie may actually hang below the broad end. Or, the broad end of the tie may hang too long below the waistline and be visible below the bottom of a suit coat. If the same tie were always worn, a person might learn how judge where to start the knot based on where the broad end of the tie overlies the narrow end of the tie, but few people become that familiar with their ties or only wear one or two different ties. Since there is uncertainty about where a knot should be started, it is common for a person to make two or more attempts to tie a knot so that the knot is correctly positioned, and the broad end of the tie hangs at the correct position, i.e., at about the top of the trousers, at the waistline. When rushing to dress, it can be very frustrating to have to retie a tie several times to achieve the proper hanging length for the broad end.

Each person will generally have a favorite knot that they use for a tie and will use the same knot each time that a tie is worn. Examples of the most common types of knots include the Windsor, Half Windsor, Pratt, Prince Albert, Victoria, and the Four-in-Hand. The portion of the total length of tie that is used to tie these different types of knots may vary, depending upon the knot. For example, the Four-in-Hand knot uses more of the tie length to form the knot than the Half Windsor. Thus, if a person decides to start tying their ties with a different type of knot, then the experience relied upon for where to start the knot may change, making it even more likely that the person will need to make several attempts before succeeding in tying the tie with the correct hanging length for the broad end of the tie.

Accordingly, it would be desirable to apply a systematic approach to tying a tie that guarantees that the hanging length of the broad end of the tie will always be correct. The systematic approach should be appropriate regardless of the length of the tie (at least within the normal range for tie lengths) for a given type of knot used for tying the tie. It would also be desirable to be able to purchase a kit to more readily use this systematic approach.

SUMMARY

This application specifically incorporates by reference the disclosure of the patent application identified above as a related application.

One aspect of this technology is directed to a method for determining where to locate a reference point for use in starting to tie a knot in a tie having a broader portion that is adjacent to a broad end and a narrower portion that is adjacent to a narrow end of the tie, so that when the tie is worn after the knot is tied, the broad end will be disposed at a desired length and at a desired location adjacent to a waistline of a person wearing the tie. The method includes determining a circumference of a neck of the person at a position where the tie will be worn. A distance between the position along the neck where the knot will be when the tie is worn and the desired location adjacent to the waistline where the broad end of the tie should be disposed is measured. In addition, a type of the knot to be used in tying the tie is selected. As a function of the circumference of the neck, the distance between the position along the neck and the desired location adjacent to the waistline, and the type of knot selected, a distance from the broad end of the tie to a marker location for the reference point on the back of the broader portion of the tie, where a marker should be applied is then determined. The marker is applied at the marker location on the back of the tie. Thereafter, each time that the tie is tied, after looping the tie around the neck of the person, the broader portion of the tie that overlaps the narrower portion of the tie is adjusted so that the marker on the back of the tie is disposed over the narrower portion of the tie, and the tying of the knot in the tie is completed.

Another aspect of the present technology is directed to a kit for marking a reference point on a tie having a broader portion that is adjacent to a broad end and a narrower portion that is adjacent to a narrow end of the tie, to indicate where a knot in the tie should be started, so that when the tie is worn after the knot is tied, the broad end will be disposed at a desired length and at a desired location adjacent to a waistline of a person wearing the tie. The kit includes at least one marker for indicating a marker location for the reference point on a back of a tie, where the broader portion of the tie should overlap the narrower portion of the tie when starting to tie the knot. Also included are instructions for determining a distance from the broad end of the tie to where the marker location for the reference point should be indicated on the back of the tie, based on a type of knot selected to be tied, a circumference of the neck of the person where the knot will be when the tie is worn, and a torso length of the person.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

Drawings

Various aspects and attendant advantages of one or more exemplary embodiments and modifications thereto will become more readily appreciated as the same becomes better understood by reference to the following detailed description, when taken in conjunction with the accompanying drawings, wherein.

DESCRIPTION

Figure 1:
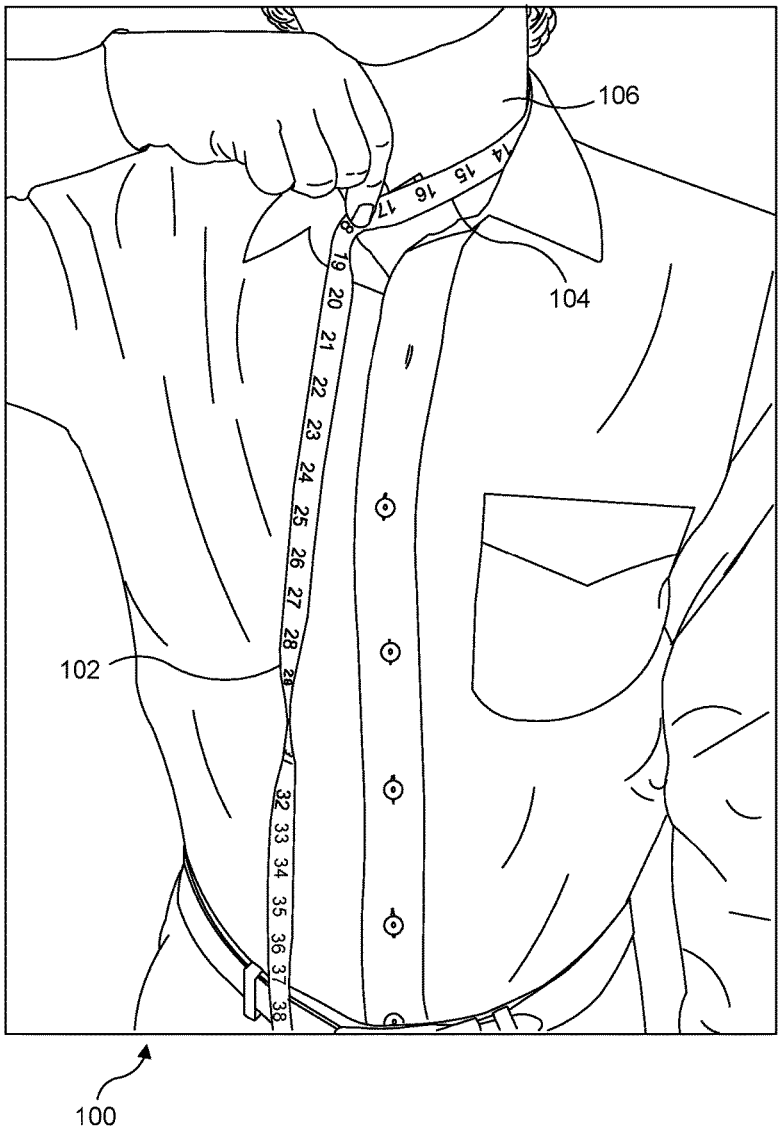
FIG. 1 is an exemplary graphic view showing how a measurement of a person's neck size can be accomplished to determine one of the variables used in the present approach for facilitating tying a tie correctly.

Figures and Disclosed Embodiments Are Not Limiting

Exemplary embodiments are illustrated in referenced Figures of the drawings. It is intended that the embodiments and Figures disclosed herein are to be considered illustrative rather than restrictive. No limitation on the scope of the technology that follows is to be imputed to the examples shown in the drawings and discussed herein.

Method for Facilitating Tying a Tie Correctly

When tying a tie conventionally, one of the uncertainties that arises is where to start forming the knot after the tie is wrapped around the person's neck. At this point, the tie will typically be positioned at the collar of a dress shirt, with the broad end of the tie and the narrow end of the tie disposed over the person's chest. For purposes of the following disclosure, the location at which a knot in a tie is initiated refers to the point at which the broader portion of a tie crosses over the narrower portion of the tie prior to wrapping around to form the knot. The present approach eliminates the uncertainty of the position where the broader portion of the tie should cross over the narrower portion by providing a marker on the back surface of the tie at the point where the crossover should occur. Since the marker is disposed on the rear surface of the tie, it is not normally visible when the tie is being worn after the knot is completed.

The present approach determines where the marker should be positioned on the rear surface of the tie so that the uncertainty of where the broader portion should cross over the narrower portion of the tie is eliminated and so that the tie will be properly tied each time—with the appropriate length of the broad end of the tie hanging below the knot.

To determine where the marker should be positioned on the back surface of the tie, two variables must be known for use in determining the distance from the tip of the broad end of the tie to the marker position. These variables generally need only be measured (or otherwise determined) one time, unless changes in the person's anatomical size occurs.

The first variable is the size of the person's neck, N, measured at the nominal position where the tie will be worn around the neck. This neck size, N, will often already be known, since the variable corresponds to the neck size of the shirts worn by the person. Alternatively, as shown in an exemplary graphic image 100 in FIG. 1, a person can use a flexible tape 102 to measure the neck size at a position 104 on neck 106 where a tie will be worn. Although the measurement is shown as being made around the bare skin of the neck in FIG. 1, it is contemplated that the measurement can also be made around the collar of a shirt that is buttoned at the neck. The difference between these two measurements should generally be insignificant, but clearly, the neck size would be slightly greater when measured over the interior neck fabric of a shirt.

The other variable is the person's torso length, T, measured from where the knot will be disposed at the person's neck after it is tied, to the point at which the tip of the broad end of the tie should hang. As shown in an exemplary graphic image 200 in FIG. 2, flexible tape 102 can be used to measure from a position 202 that is disposed just below the person's Adam's apple—for a male (or just above the notch between the collar bones), down to a position 204, which is just above a waistline 206 of trousers 208, where the tip of the broad end of the tie should hang when the tie is tied correctly.

Figure 2:
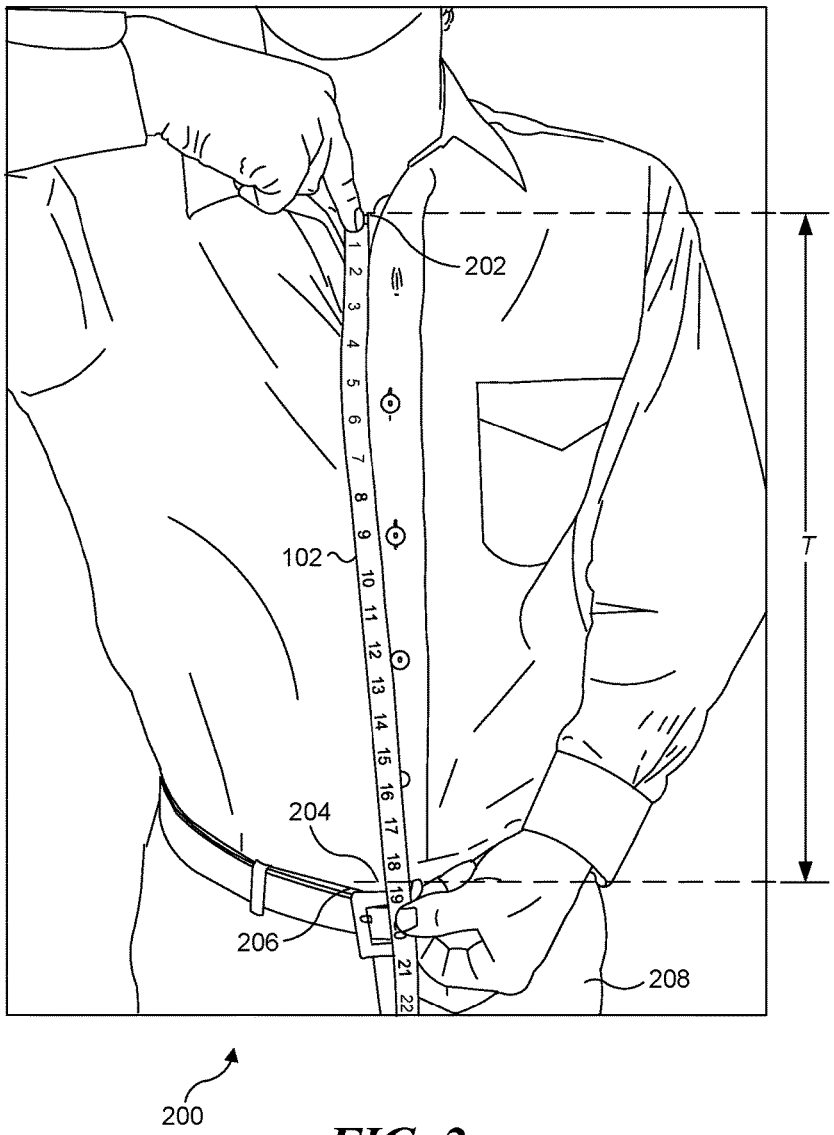
FIG. 2 is an exemplary graphic view showing how a measurement of a person's torso length can be accomplished to determine another of the variables used in the present approach for facilitating tying a tie correctly.

There is an option for adjusting this lower point for the hanging tie when determining the torso length, T, based on personal preference. If the person believes that a properly tied tie should hang to a point that is short of or lower than the waistline, then the measurement should be made to the point preferred by the person, rather than to position 204 as shown in FIG. 2.

Once the two variables, N and T, have been determined, the person should select the type of knot that will be used for tying ties worn by the person. By way of example, and without any implied limitation of the type of knot to which the present approach is applicable, a person might choose either a Windsor, Half Windsor, Pratt, Prince Albert, Victoria, or Four-in-Hand knot. The person can then apply the following formula to calculate a position for placing a mark on the rear surface of each tie that is to be tied with the chosen knot:

$$N+T-C=MP$$

where C is a constant based on the chosen knot, as noted below, and MP is length determined for a position to place a marker, as measured from the tip of the broad end of the tie. Exemplary values for C are indicated in the following Table 1 for at least some of the possible knots that might be used. If a type of knot not shown in Table 1 is chosen, then the value of C can be modified based on the relative portion of the tie that is used for tying the chosen knot, compared to that required for tying one of the knots listed in the table.

TABLE 1

| Knot | Value of C |
|---|---|
| Windsor | 2 |
| Half Windsor | 6 |
| Pratt | 8 |
| Prince Albert | 6 |
| Victoria | 6 |
| Four-in-Hand | 10 |

Alternatively, a graph for each of a plurality of different types of knots can be employed to determine the value of MP based on the two variables, N and T, along with a choice of the type of knot to be used to tie a tie. As a further alternative, the two variables and the type of knot that will be used for tying the tie can be input in response to prompts on a website that is accessible online on the Internet, or within a software program running on a computing device. The value of MP is then determined and displayed to the person in response to these inputs. If a software program is used, the computing device might be, by way of example and without any implied limitation, a personal computer, a laptop, a smart phone, a tablet, or some other logic device that is programmed to determine the value of MP after a user inputs the two variables, N and T and selects a desired type of knot.

Figure 3:
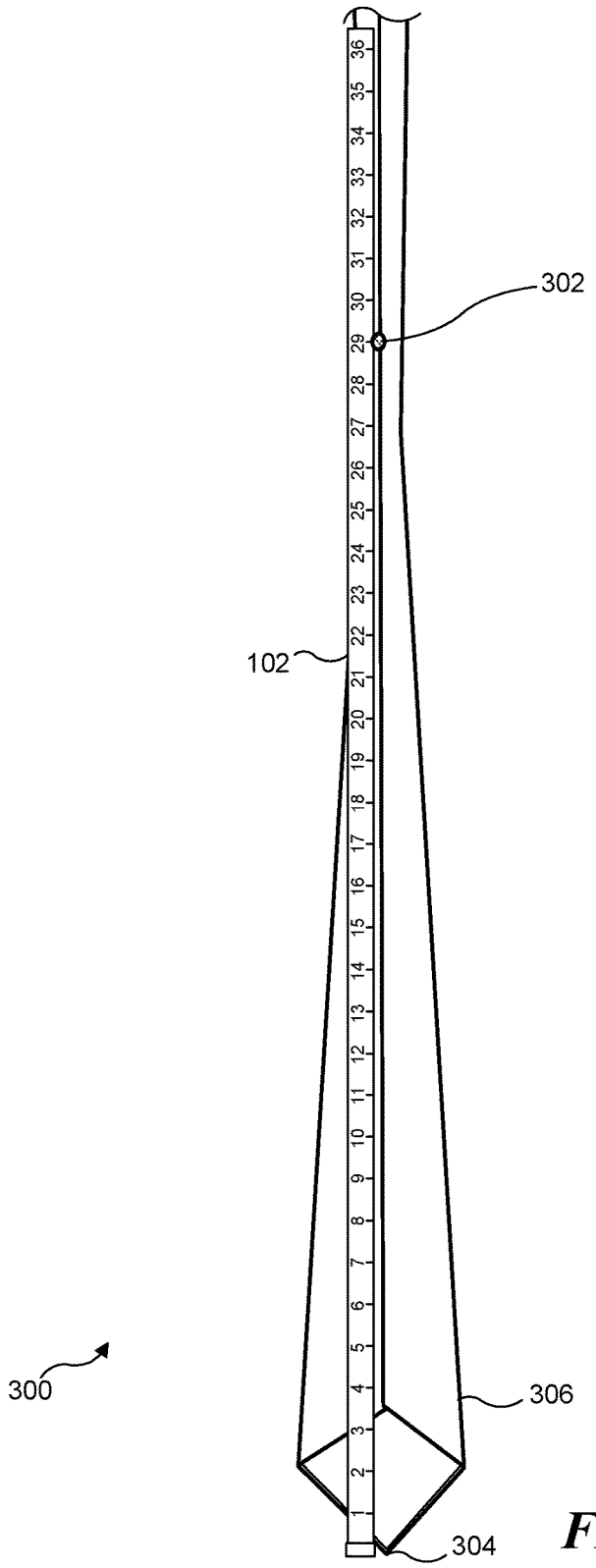
FIG. 3 is a partial view of the back surface of an exemplary tie showing how a measurement is made from a lower end of the broad end of the tie to determine where a marker should be placed for use in facilitating tying the tie correctly.

FIG. 3 illustrates a tie 300 and shows how flexible tape 102 can be employed to measure the length MP from a tip 304 of a broad end 306 of tie 300 to a position where a marker 302 should be placed to facilitate the person correctly tying the chosen knot in the tie. In the example shown in FIG. 3, the position for placing marker 302 is based on a determination that the value of MP is 29 inches. In this example, marker 302 is an adhesive-backed disk that is readily adhered to the position measured from the tip of the broad end of tie 300. Marker 302 may be made, for example, of plastic, cardboard, or paper. However, it is also contemplated that other types of markers may be employed for marking the position that was determined based on the length, MP. For example, a marking pen might be used to make a mark at the position on the back surface of the tie corresponding to the length MP, or a piece of adhesive tape might be applied to the rear surface of the tie at that position. As a further alternative, a button might be stitched to the rear surface of the tie at the position determined, or a pin clip might be applied at the position. Generally, use of a physical marker will be preferable to a mark that is simply visible, but not perceptible by tactile feel, since when tying the tie, a person can use a finger to feel where the marker is disposed on the back surface of the tie, to determine where the broader portion of the tie should be crossed over the narrower portion when initially starting to form the knot in the tie.

Figure 4:
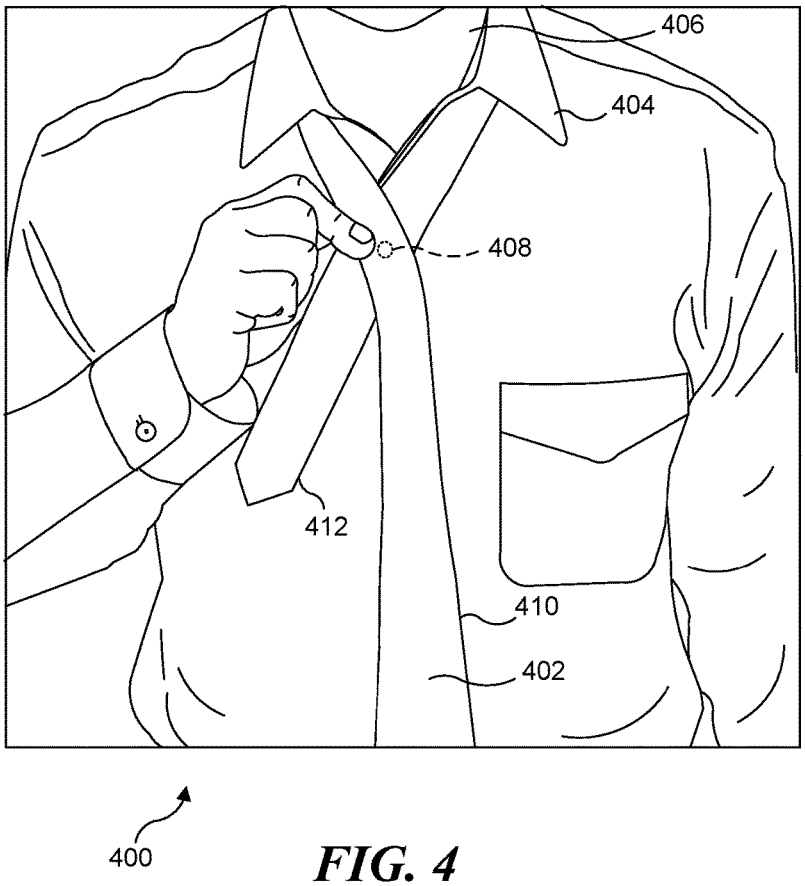
FIG. 4 is an exemplary graphic image showing how the marker is used to determine where the broader portion of the tie crosses over a narrower portion of the tie when initiating tying a knot in the tie in accord with the present approach.

As shown in an exemplary graphic image 400 in FIG. 4, a tie 402 that has been wrapped around a collar 404 at a person's neck 406 includes a marker 408 attached to the back surface of the tie. A broader portion 410 of tie 402 is crossed over a narrower portion 412 of the tie at marker 408 when initially starting to form the knot in the tie. It should be noted that the crossing over can be from right-to-left or from left-to-right—depending on the preference of the person tying the tie. The portions of the tie that cross at marker 408 are held at the position of the marker between the thumb and forefinger of the person while person continues to form the chosen knot. For example, for tying most types of knots, the broader portion of the tie would next be brought under the narrower portion. The following step would depend upon the type of knot being tied. In any case, it will be apparent that using the marker's position to determine where the broader portion crosses the narrower portion of the tie and then pinching the portions of the tie together at that position will enable the rest of the steps used for tying a knot to be initiated at a fixed location—regardless of the type of knot chosen.

Figure 5:
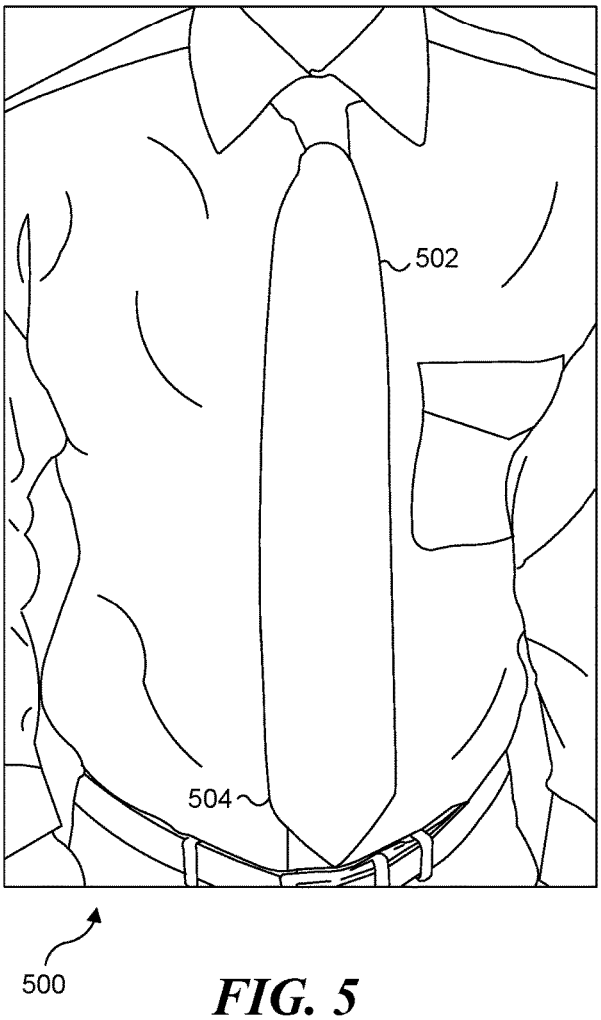
FIG. 5 is an exemplary graphic image showing how the present approach and kit successfully enables a tie to be tied with the correct hanging length for the broad end of the tie.

FIG. 5 illustrates an exemplary graphic image 500 showing how the present approach can facilitate tying a tie 502 so that its broad end 504 hangs correctly at the waistline of the person. As noted above, the "correct" position at which the broad end of tie 502 hangs can be varied based on a person's preferences when measuring the torso length variable, T.

Figure 6:
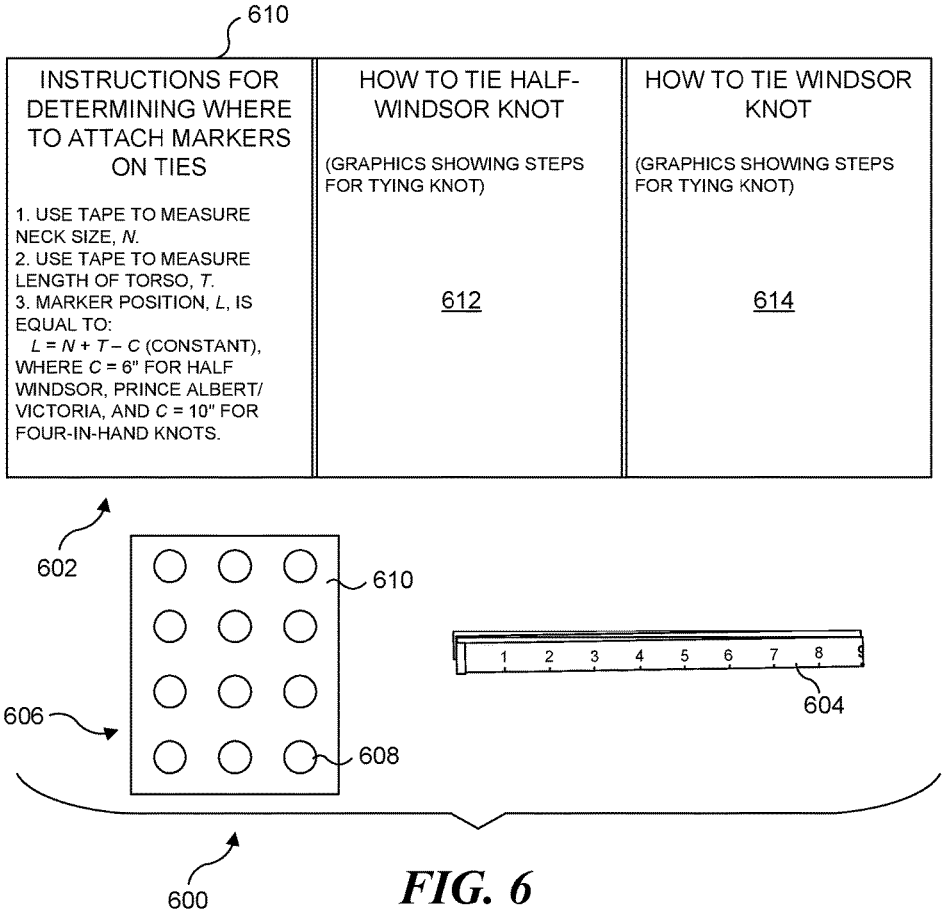
FIG. 6 illustrates the components of a kit used to facilitate correctly tying a plurality of ties.

An exemplary kit 600 for use in facilitating correctly tying a tie is illustrated in FIG. 6. Kit 600 includes a tri-fold brochure 602, a folded flexible tape 604, and a marker pack 606 having a plurality of adhesive backed plastic markers 608 that are temporarily affixed to a backing sheet 610. The adhesive applied to the back of plastic markers 608 is one that is suitable for semi-permanently adhering the markers to fabric material of the type used for making ties, e.g., silk, linen, cotton, wool, synthetic fibers, such as polyester, and microfibers, or blends thereof. Other types of markers may alternatively be provided in the kit, as discussed above.

Tri-fold brochure 602 includes a panel 610 with instructions for determining where to attach markers 608 to the rear surface of ties, generally as described above, but may also direct a person to a web site where the variables measured with folded flexible tape 604 can be input to determine the value of MR. Other panels 612 and 614 (and panels on the reverse side of the tri-fold brochure—not shown) provide graphic images and instructions showing how to tie various types of knots, such as the Half-Windsor and Windsor. By using kit 600, a person can readily determine the value of MR based on measurements of the neck size and torso length, and then mark a plurality of their ties with markers 608 at positions measured using that value, so that the person can correctly tie a chosen knot in each of the ties without any problem in determining the initial starting point for crossing the portions of the tie.

Although the concepts disclosed herein have been described in connection with the preferred form of practicing them and modifications thereto, those of ordinary skill in the art will understand that many other modifications can be made thereto, within the scope of the claims that follow. Accordingly, it is not intended that the scope of these concepts in any way be limited by the above description.

What is claimed is:

1. A method for determining where to locate a reference point for use in starting to tie a knot in a tie having a broader portion that is adjacent to a broad end and a narrower portion that is adjacent to a narrow end of the tie, so that when the tie is worn after the knot is tied, the broad end will be disposed at a desired length and at a desired location adjacent to a waistline of a person wearing the tie, comprising:

(a) determining a circumference of a neck of the person at a position where the tie will be worn;

(b) measuring first a distance between the position along the neck where the knot will be when the tie is worn and the desired location adjacent to the waistline where the broad end of the tie should be disposed;

(c) selecting a type of the knot to be used in tying the tie;

(d) as a function of the circumference of the neck, the first distance between the position along the neck and the desired location adjacent to the waistline, and the type of knot selected, determining a second distance from the broad end of the tie to a marker location for the reference point on the back of the broader portion of the tie, where a marker should be applied, the determining comprising calculating the second distance from the following equation:

$$N+T-C=MP$$

where N is the circumference of the neck at the position where the tie will be worn, T is the first distance between the position along the neck where the knot will be and the desired location where the broad end of the tie should be disposed, C is a constant having a value that depends upon the type of knot selected for tying the tie, and MP is the second distance that is determined;

(e) applying the marker at the marker location on the back of the tie;

(f) thereafter, each time that the tie is tied, after looping the tie around the neck of the person, adjusting the broader portion of the tie that overlaps the narrower portion of the tie so that the marker on the back of the tie is disposed over the narrower portion of the tie; and (g) completing the tying of the knot in the tie.

2. The method of claim 1, further comprising providing the user a plurality of different types of knots for tying a tie, along with a corresponding value of C for each different type of knot, to enable the person to select the knot for tying the tie and thereby determine the value of C that should be used in the equation.

3. The method of claim 1, wherein determining the second distance from the broad end of the tie to the marker location on the back of the tie where the marker should be applied comprises providing a software program in which the circumference of the neck at the position where the tie will be worn, the first distance between the position along the neck where the knot will be and the desired location where the broad end of the tie should be disposed, and the type of knot selected for tying the tie are entered, the software program computing the second distance from the broad end of the tie to the marker location.

4. The method of claim 1, wherein determining the second distance from the broad end of the tie to the marker location on the back of the tie where the marker should be applied comprises providing a designated website where the circumference of the neck at the position where the tie will be worn, the first distance between the position along the neck where the knot will be and the desired location where the broad end of the tie should be disposed, and the type of knot selected for tying the tie are input, the designated website then computing and displaying the second distance from the broad end of the tie to the marker location on the back of the tie.

5. The method of claim 1, wherein the marker is applied by adhesively securing the marker to the back of the tie at the marker location.

6. The method of claim 1, wherein the marker is applied by marking the back of the tie with a mark at the marker location using a marking pencil or marking pen.

7. The method of claim 1, wherein the marker is applied by attaching an object to the back of the tie at the marker location, so that the object provides a tactile indication of where the marker location is disposed.

8. The method of claim 1, wherein determining the circumference of the neck of the person at the position where the tie will be worn comprises measuring the circumference with a flexible tape measure.

9. The method of claim 1, wherein determining the circumference of the neck of the person at the position where the tie will be worn comprises using a neck size of a shirt worn by the person as the circumference.

10. The method of claim 1, further comprising using a measuring device to measure the first distance between the position along the neck where the knot will be and the desired location where the broad end of the tie should be disposed, and to measure the second distance from the broad end of the tie to the marker location on the back of the tie.

* * * * *